United States Patent [19]

Heinzmann et al.

[11] Patent Number: 4,776,718

[45] Date of Patent: Oct. 11, 1988

[54] WRITING IMPLEMENT

[75] Inventors: Werner Heinzmann, St. Georgen; Klaus Frietsch, Schramberg, both of Fed. Rep. of Germany

[73] Assignee: Schmidt Feintechnik GmbH, St. Georgen, Fed. Rep. of Germany

[21] Appl. No.: 25,147

[22] PCT Filed: May 9, 1986

[86] PCT No.: PCT/DE86/00193

§ 371 Date: Jan. 28, 1987

§ 102(e) Date: Jan. 28, 1987

[87] PCT Pub. No.: WO86/06686

PCT Pub. Date: Nov. 20, 1986

[30] Foreign Application Priority Data

May 9, 1985 [DE] Fed. Rep. of Germany ..... 3516646

[51] Int. Cl.[4] ..... B43K 8/00

[52] U.S. Cl. ..... 401/196; 401/198; 401/199; 401/206; 401/260; 401/292

[58] Field of Search ..... 401/192, 258, 292, 199, 401/216, 209, 145–148, 191, 196, 198, 200, 205, 206, 219, 220, 258–260, 263, 264, 99, 101

[56] References Cited

U.S. PATENT DOCUMENTS

| | | | |
|---|---|---|---|
| 2,029,152 | 1/1936 | Bonkowski | 401/292 X |
| 3,113,336 | 12/1963 | Langnickel | 401/198 X |
| 3,221,360 | 12/1965 | Seeman | 401/198 X |
| 3,680,968 | 8/1972 | Schwartzman et al. | 401/292 X |
| 3,832,071 | 8/1974 | Chaney | 401/258 X |
| 4,145,148 | 3/1979 | Fukuoka | 401/209 |
| 4,364,684 | 12/1982 | Kohno et al. | 401/292 X |
| 4,496,258 | 1/1985 | Tanaka et al. | 401/198 X |

FOREIGN PATENT DOCUMENTS

| | | | |
|---|---|---|---|
| 60-011398A | of 1985 | Japan | 401/258 |
| 7108297 | of 1972 | Netherlands . | |

*Primary Examiner*—Richard J. Apley
*Assistant Examiner*—David J. Bender
*Attorney, Agent, or Firm*—Mason, Fenwick & Lawrence

[57] ABSTRACT

A writing implement having at its front end a small writing tube and a writing wick axially slidable in it. The writing wick at its inner end has an enlarged head which engages a restoring spring. The restoring spring is part of a retaining ring which holds the spring in the implement, and the retaining ring has capillary ducts to convey ink between ink-conducting passages and the writing wick.

9 Claims, 2 Drawing Sheets

III-III

IV-IV

V-V

VI-VI

WRITING IMPLEMENT

BACKGROUND OF THE INVENTION

As in the case of the small tube writing implement described, for example, in DE-OS 30 23 189, in the case of this implement, liquid ink, via a small tube, is applied to the writing pad. In the small tube, a wire shaped or wick shaped writing element is arranged that, together with the interior wall of the small tube, forms ink feeding ducts. Said writing wick projects over the end of the small tube located on the outside and, together with it, forms the writing point. It can be slid axially in the small tube against the effect of a spring element. The spring element has the effect that the writing point in any writing postion remains in contact with the writing pad. By means of the axial movement of the writing wick that occurs automatically during the writing, impurities are removed from the small tube. In addition, the pump effect that occurs when the writing point is placed on the pad supports this effect.

In the case of the writing implement according to DE-OS 30 23 189, this spring element consists of an ink permeable plastic-foam cushion or similar device.

This plastic-foam cushion has two disadvantages.

On the one hand, the restoring force of the cushion decreases in the course of the usage period, whereby the operatability of the writing implement may be impaired.

On the other hand, a plastic-foam cushion of the density that is required for the purpose of elasticity has only a limited ink permeability.

In order to achieve, in the case of writing implements of this type, a better capacity for open storage than in the case of the known small-tube writing implements, unpigmented inks must be used instead of pigmented inks. It is known that the latter have a much better covering capacity than unpigmented ink types. In order to nevertheless achieve by means of these ink types a comparable blackening and covering capacity of the produced lines, a more intensive ink delivery is required. However, this more intensive ink delivery, in the case of the writing implement disclosed in DE-OS 30 23 189, is not ensured, mainly as a result of the plastic-foam cushion.

SUMMARY OF THE INVENTION

The present invention is therefore based on the objective of improving the flow of ink in the case of writing implements of this type, and particularly of achieving a higher delivery with respect to the amount of ink relative to the writing path.

In general, this objective is achieved by means of an improvement of the flow of ink into the area of the inner end of the writing implement.

The individual measures are the object of the claims and are in the following explained in detail by means of two embodiments that are shown in the drawing.

DETAILED DESCRIPTION OF THE DRAWINGS

Figure 1:
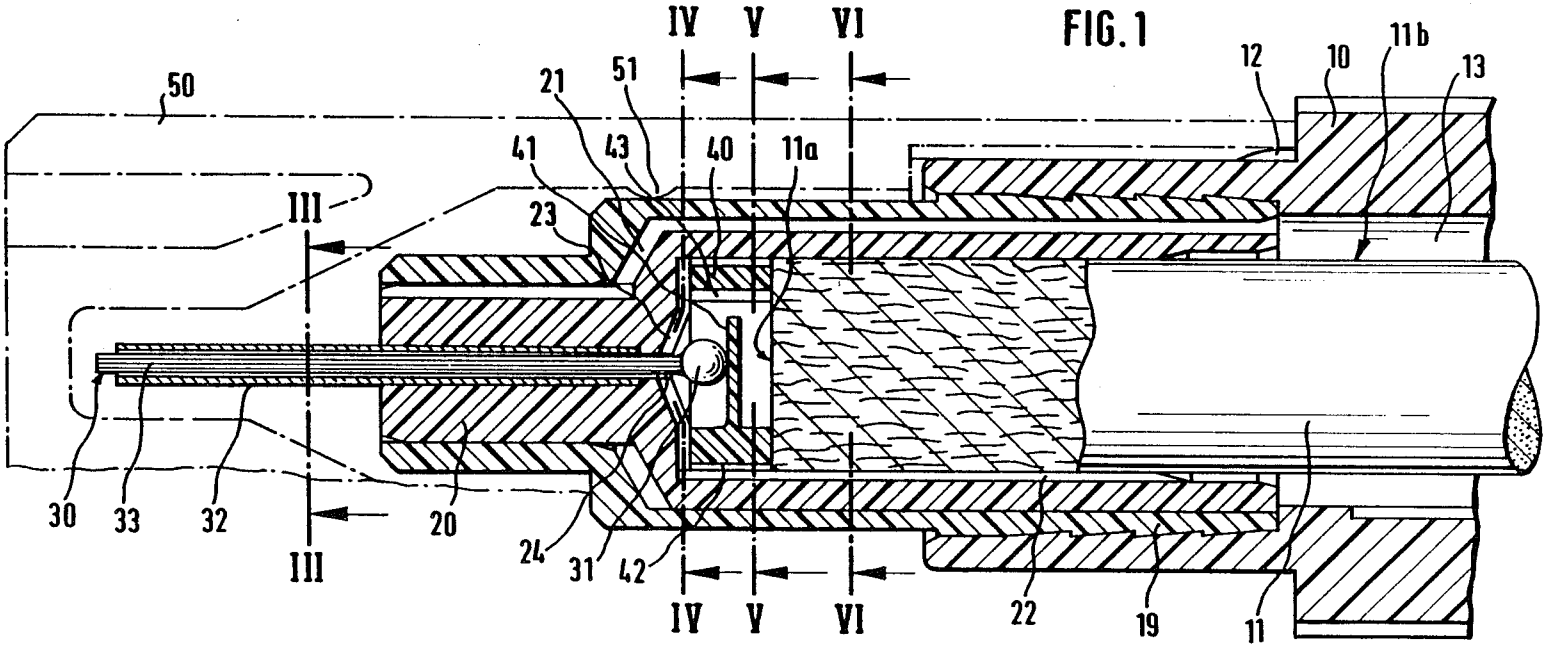
FIG. 1 is an axial sectional view of a writing implement developed according to the invention in the area of the writing point with an outlined closing cap according to a first embodiment.

In the drawing, only the elements are shown that are required for the understanding of the invention.

Not shown is the ink reservoir located in the rear part of the casing 10, from which the liquid ink, by means of an ink conducting means 11, is transported into the front area of the writing point on the basis of the capillary effect of the ink-conducting means.

Figure 3:
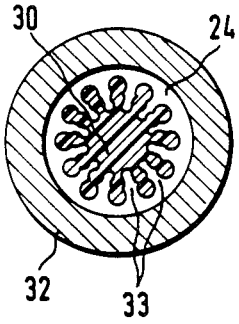
FIG. 3 is a radial sectional view along the Line III—III in FIG. 1.

A mounting 19 with a coaxially press-in sheath 20 is inserted into the front end of the casing 10. The sheath 20, at one end, receives the front end of the ink-conducting means 11 and, at the other end, carries the writing wick 30 disposed in the small writing tube 32. In the case of this embodiment according to FIG. 1, the writing wick 30 consists preferably of a thermoplastic material, and in its shell surface has axially extending capillary ducts 33, as shown in the sectional view according to FIG. 3.

At its inner end, the writing wick 30 is thickened to form a ball head 31.

Figure 4:
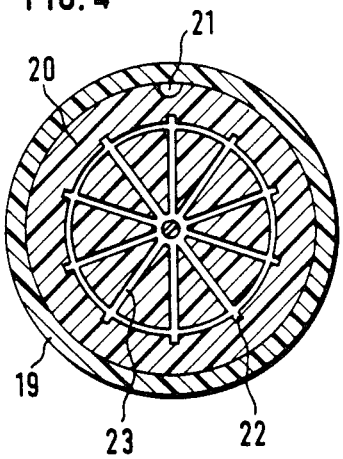
FIG. 4 is a radial sectional view along the Line IV—IV in FIG. 1.
Figure 5:
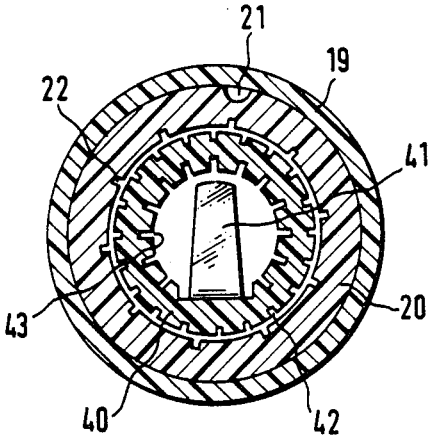
FIG. 5 is a radial sectional view along the Line V—V in FIG. 5.

Between the writing wick 30 and the ink-conducting means 11, a spring element is inserted into the sheath 20, said spring element consisting of a ring 40 with a restoring spring 41 projecting into the inside of the ring. This restoring spring is developed and arranged in such a way that, as shown in the sectional view according to FIG. 5, the ink emerging from the ink-conducting means 11, in an unhindered way, can reach the writing wick 30. In order to promote this flow of ink, axially extending capillary ducts 42 and 43 are also arranged on the outer and inner shell surface of this ring 40. These capillary ducts 42 and 43 guide the ink emerging from the ink-conducting means 11 to radially extending collecting ducts 23 that are injected into the sheath 20 (compare FIG. 4). This ensures that always a sufficient amount of ink collects in the area of the ring-shaped capillary gap 24. From here, the ink moves, via the capillary ducts 33 of the writing wick 30, to the front end of the writing point in order to be able to emerge here at contact with the writing pad.

During the writing process, the restoring spring 41 has the effect that the longitudinally movable writing wick 30 is pressed against the writing pad so that in any writing position, the contact with the writing pad is maintained. When the writing point is placed on the pad and lifted off the pad, the writing wick 30 is moved axially against the effect of the restoring spring 41, whereby, on the one hand, by means of the mechanical effect, and, on the other hand, by means of the pump effect, impurities are removed from the small writing tube 32.

The restoring spring 41 also causes a soft contact of the writing point on the writing pad resulting in a pleasant feeling during drawing and writing.

This effect, according to another suggestion of the invention, is promoted by means of the fact that the small writing tube 32 is provided with a mechanically resistant material, such as a titanium nitride coating which, in addition, results in an substantial resistance to abrasion and protection against corrosion at all tempeatures encountered in normal usage of writing implements.

Figure 6:
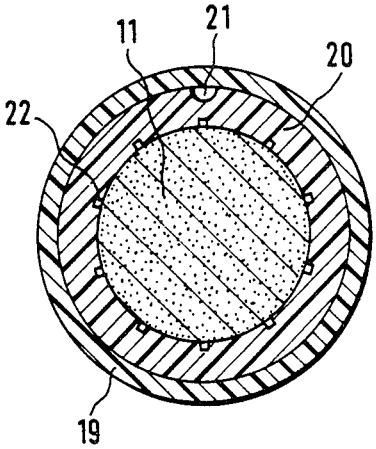
FIG. 6 is a radial sectional view along the Line VI—VI in FIG. 1.

For a further improvment of the flow of ink from the ink reservoir that is not shown, via the ink-conducting means 11, to the interior end of the writing wick 30, the interior shell surface of the sheath 20 is provided with preferably injected axially extending capillary ducts 22 (compare FIG. 6). As a result, it is achieved that the ink is guided not only over the front surface 11*a* of the ink-conducting means, but also to a considerable extend, over the shell surface 11*b* of the ink-conducting means. The ink that is fed via the capillary ducts 22, via the radial ducts 23, arrives at the ring-shaped capillary gap 24. In addition, the ink discharged through the capillaries 42 and 43 on the front side at the ink-conducting means creeps between the ring 40 and the front side of the bore in the sheath 20 in a capillary way to the radial ducts 23 and thus also reaches the ring gap 24.

An air duct 21 provided in the sheath 20 connects the outside air with the ring-shaped air gap 13 surrounding the ink-conducting means, said air gap 13 itself being connected with the ink reservoir that is not shown, whereby the latter is ventilated when the ink is supplied.

When pigmented inks are used, writing implements according to the invention can be stored significantly longer than conventional inking implements operating with pigmented ink. Thus storage capabilities of more than a year can be reached, if, as indicated in FIG. 1, the writing point is covered by a closing cap 50. In this case, a sealing ring 51 resting on the exterior surface of the sheath 20 has the effect that the space in the area of the front end of the writing point is sealed off and has only little volume.

Figure 2:
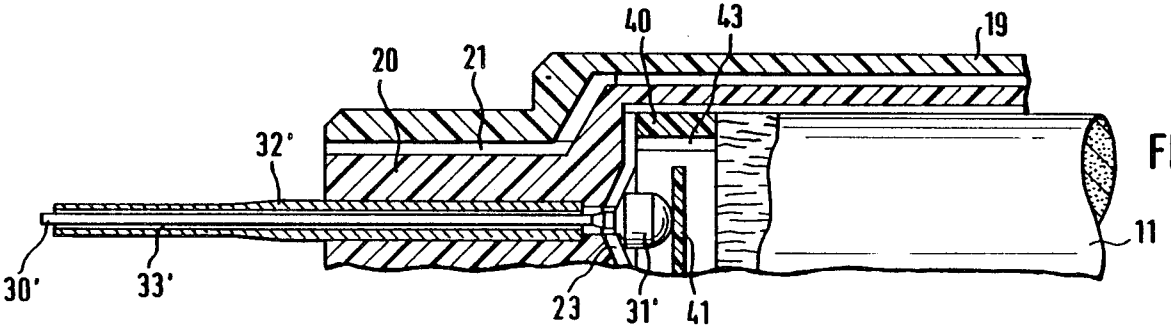
FIG. 2 is a partial axial sectional view corresponding to the representation according to FIG. 1 of a writing implement according to the invention according to a second embodiment, but without a closing cap.

For fine line widths, the use of a writing wire 30' is recommended instead of the writing wick 30 consisting of plastic, as shown in FIG. 2. This writing wire 30', with the correspondingly dimensioned small writing tubes 32' delimits a capillary ring gap 33' via which, in the same way as with the capillary ducts 33, ink is transported to the writing point. To its inner end, a ball head 31' is sprayed that preferably consists of plastic and against which rests a restoring spring 41.

For the remainder, the method of operation of this writing implement corresponds to that of the writing implement according to FIG. 1.

The capillary system designed according to the invention, because of its large effective surface and its large storage volume, has the effect that the writing medium is guided to the writing point without delay, in an even manner and in sufficient quantity.

In addition, the writing implement is designed in such a way that, because of its simple construction that is easy to produce, a cost-effective manufacturing is made possible. Thus, the writing implement consists essentially only of the casing 10, the mounting 19, the sheath 20 with the small writing tube 32 and the writing wick 30, the spring element with the ring 40 and the restoring spring 41, the ink-conducting means 11 and the not shown ink reservoir. All parts are developed in such a way that they can be manufactured and asesmbled by means of simple tools.

We claim:

1. A writing implement for liquid ink having an ink supply, a small writing tube, a writing element axially slidable in said small writing tube, the outer end of said writing element projecting beyond the small writing tube thereby forming a writing point together with the writing tube, the inner end of said writing element being enlarged, a spring element in said implement comprising a ring having an inside and an outside surface, said ring surrounding the enlarged inner end of the writing element and spaced therefrom, a restoring spring projecting inwardly from the ring, said enlarged inner end of said writing element engaging said spring, said spring urging said element outwardly, and at least one axially extending capillary duct in at least one of said surfaces of the ring, for enabling ink to pass said ring, and passage means for passing ink inwardly from the capillary duct of the ring to the writing element.

2. A writing implement according to claim 1, wherein the ring and the restoring spring are in integral, one-piece plastic element.

3. A writing implement according to claim 1, and further comprising a casing having a front end, a mounting inserted into the front end of the casing, a sheath in said mounting, said sheath having an open bore at its rear, ink-conducting means extending into said sheath through said open rear bore, said sheath having a front bore of a smaller cross-section than said rear bore, the small writing tube being in said front bore, the writing element being in said writing tube and having an annular gap there-between, and said spring element being in the rear bore between the ink-conducting means and the writing element.

4. A writing implement according to claim 3, and further comprising means for passing ink from the outer surface of said ink-conducting means along the interior surface of the rear bore of the sheath and radially inwardly therefrom to the annular gap between said writing element and the front bore of the sheath.

5. A writing implement according to claim 4, said passing means comprising axially extending ducts in said sheath along the rear bore thereof.

6. A writing implement according to claim 1, wherein said writing element is a writing wick comprising thermoplastic material, the inner end of said wick being thickened to form a ball head, the surface of said wick having axially extending ducts therein.

7. A writing implement according to claim 1, wherein said writing element is a metallic writing wire having a ball head of plastic thereon, and a gap between the small writing tube and said wire.

8. A writing implement according to claim 1, wherein the small metallic writing tube is coated with a mechanically resistant material.

9. A writing implement according to claim 8, wherein said mechanically resistant material is titanium nitride

* * * * *